US008393129B2

(12) United States Patent
Arsene et al.

(10) Patent No.: US 8,393,129 B2
(45) Date of Patent: Mar. 12, 2013

(54) METAL COMPOSITE PANEL AND METHOD OF MANUFACTURE

(75) Inventors: Sylvie Arsene, Grenoble (FR); Jérôme Guillemenet, Fontaine les Dijon (FR); Céline Andrieu, Vic le Comte (FR); Myriam Bouet-Griffon, Venon (FR)

(73) Assignee: Constellium France, Paris (FR)

( * ) Notice: Subject to any disclaimer, the term of this patent is extended or adjusted under 35 U.S.C. 154(b) by 956 days.

(21) Appl. No.: 12/028,226

(22) Filed: Feb. 8, 2008

(65) Prior Publication Data

US 2008/0202066 A1 Aug. 28, 2008

Related U.S. Application Data

(60) Provisional application No. 60/945,271, filed on Jun. 20, 2007.

(30) Foreign Application Priority Data

Feb. 9, 2007 (FR) ..... 07 00923

(51) Int. Cl.

| | |
|---|---|
| ***E04C 2/54*** | (2006.01) |
| ***E04C 2/36*** | (2006.01) |
| ***E04C 2/00*** | (2006.01) |
| ***E04C 2/32*** | (2006.01) |
| ***E04C 2/38*** | (2006.01) |

(52) U.S. Cl. ..... 52/783.17; 52/793.11; 52/796.12; 52/797.1; 52/798.1; 52/799.11

(58) Field of Classification Search ..... 52/783.17, 52/793.11, 796.12, 797.1, 798.1, 799.1, 799.11; 29/428; 420/532

See application file for complete search history.

(56) References Cited

U.S. PATENT DOCUMENTS

| | | | | | |
|---|---|---|---|---|---|
| 3,258,892 | A | * | 7/1966 | Rushton | 52/789.1 |
| 4,425,980 | A | * | 1/1984 | Miles | 181/208 |
| 5,128,195 | A | * | 7/1992 | Hegedus | 428/174 |
| 5,162,143 | A | * | 11/1992 | Porter et al. | 428/179 |
| 5,247,749 | A | * | 9/1993 | Bury | 33/503 |
| 5,348,601 | A | * | 9/1994 | Ray | 156/155 |
| 5,415,715 | A | * | 5/1995 | Delage et al. | 156/197 |
| 5,424,113 | A | * | 6/1995 | Ray et al. | 428/178 |
| 5,514,445 | A | * | 5/1996 | Delage et al. | 428/116 |
| 5,543,204 | A | * | 8/1996 | Ray | 428/179 |
| 5,635,306 | A | * | 6/1997 | Minamida et al. | 428/593 |
| 5,876,831 | A | * | 3/1999 | Rawal | 428/117 |

(Continued)

FOREIGN PATENT DOCUMENTS

| | | |
|---|---|---|
| EP | 0589054 | 3/1994 |
| EP | 1190805 | 3/2002 |
| FR | 2207581 | 6/1974 |
| FR | 2747948 | 5/1997 |
| WO | 0232598 | 4/2002 |

*Primary Examiner* — Mark Wendell
(74) *Attorney, Agent, or Firm* — Banner & Witcoff, Ltd.

(57) ABSTRACT

The invention relates to a metal composite panel intended for construction, including at least two substantially parallel sheets (21) and (22) with at least three profiles (3) substantially parallel to each other arranged between and fastened to the sheets. The three profiles serve as separators, making it possible to separate the sheets and are arranged so that the average distance between two adjacent profiles is not necessarily uniform but suited to the local conditions of use of said panel. In order to obtain a panel having an optimal compromise between weight and performance, light alloys and, in particular, aluminum are advantageous. The composite panels are particularly useful as a floor of a rolling vehicle, as the floor, deck or ramp of a floating vehicle or as the floor of a flying vehicle.

22 Claims, 6 Drawing Sheets

U.S. PATENT DOCUMENTS 5,894,044 A * 4/1999 Norcom et al. ..... 428/116
6,209,273 B1 * 4/2001 Jeffers et al. ..... 52/220.7
6,848,233 B1 * 2/2005 Haszler et al. ..... 52/783.17
7,334,374 B2 * 2/2008 Schmid ..... 52/361
7,690,720 B2 * 4/2010 Wang et al. ..... 296/193.11
2003/0154679 A1 * 8/2003 Swiszcz et al. ..... 52/506.07
2004/0074206 A1 * 4/2004 Tanase et al. ..... 52/783.17
2008/0127607 A1 * 6/2008 Schiffmann et al. ..... 52/793.11
2008/0271400 A1 * 11/2008 Raidt et al. ..... 52/408

* cited by examiner

METAL COMPOSITE PANEL AND METHOD OF MANUFACTURE

FIELD OF THE INVENTION

This invention relates to a structural composite panel made of aluminium including two parallel sheets joined together by profiles and its method of manufacture. The invention is particularly useful in the field of large-size vehicle construction.

BACKGROUND

Hollow composite panels are used in a large number of structures. In particular, horizontal panels are used as flooring and vertical panels are used to produce separations in the fields of structural engineering, industrial construction, and in the transportation field (particularly shipbuilding, truck construction and aircraft construction).

In the case of horizontal panels used in the transportation field (boat deck, truck floor), there is a strong advantage in reducing the weight of the panels so as to contribute to a reduction in the total empty weight and to thereby enable savings in fuel, an increase in the weight transported and/or increased speed.

FR 1 024 889 discloses a plurality of geometries for hollow composite panels including two walls held by separating parts consisting of thin corrugated or embossed metal sheets or the like, running uninterruptedly over the entire surface of a panel element.

The use of metal sheets does not make it possible to achieve sufficient degrees of mechanical strength for the most demanding constructions.

U.S. Pat. No. 6,574,938 (Donati) discloses a sandwich panel including at least one sheet and at least one fretted element the size of which is substantially similar to that of the sheet and the cross-sectional profile of which has a succession of adjacent trapezoidal patterns. The method of manufacture includes a step for winding the fretted element, which is difficult to consider for thick metal, which limits the application of this invention in terms of mechanical strength.

FR 2,207,581 (Wendel-Sidelor) discloses a hollow steel slab made of two plates held at a distance by U-shaped connecting elements and lined by watertight side elements, all elements being adhesively bonded.

EP 0 589 054 (Nippon Steel) discloses stainless steel honeycomb panels comprising a corrugated sheet or parallel groove materials.

WO 02/32598 (Kujala et al.) discloses a metal sandwich structure comprising a core which consists of a plurality of individual honeycomb sections spaced from each other, and a first and second cover panel attached to the sections by laser welding, the cover panels having their skirts brought to the proximity of each other by means of deflections.

In these inventions, the benefit of the use of aluminum is not considered. The use of aluminum to produce this type of panel, in place of denser materials such as steel, can, however, enable an appreciable weight reduction.

EP 1 133 390 (Corus Aluminum) discloses a composite aluminum panel comprising two parallel plates and/or sheets secured to the peaks and troughs of a corrugated aluminum stiffener sheet preferably via welding. One particular alloy (an alloy of the 5XXX family, containing zinc) was selected for the manufacture of the corrugated sheet. The mechanical strength properties of the panel obtained are not specified.

Another alternative is to produce a panel by welding hollow structural members. EP 1 222 993 A1 (Hitachi) thus discloses the assembling of hollow shape members by welding in order to produce a panel. This technique has the disadvantage of requiring numerous joining operations due to the limited width of the hollow shape members, which weakens the structure. In this same patent application honeycomb panels comprising edge members joined by friction stir welding are also disclosed.

The disadvantages of existing metal panels are many. In the methods including a fusion welding step, a sometimes unacceptable deformation of the panels occurs. Furthermore, when an intermediate sheet is used, the mechanical strength of the panels is limited by the characteristics of the intermediate sheet. As a matter of fact, it is difficult, and would require a costly investment, to obtain corrugated or fretted sheets from thick sheets, such as, in particular, sheets the thickness of which is greater than 1 mm or even 2 mm. Prior art panels are substantially symmetrical transversally and/or longitudinally although it would be desirable to be able to easily customize, as needed locally, the mechanical strength of the panel to the stresses that it will have to undergo, so as to optimise the local compromise between its weight and its mechanical strength.

SUMMARY

In accordance with aspects of the invention, a metal composite panel intended for construction is provided and includes at least two substantially parallel sheets and, arranged between them, profiles substantially parallel to each other and fastened to said sheets, characterized in that said profiles, numbering at least three, serve as separators making it possible to separate said sheets and are arranged so that the average distance between two adjacent profiles is not necessarily uniform but suited to the local conditions of use of said panel.

In accordance with another aspect of the invention, a method for manufacturing a metal composite panel including at least two substantially parallel sheets and, arranged between them, at least three profiles substantially parallel to each other, fastened to said sheets, and serving as separators making it possible to separate said sheets is provided. Said method includes the following successive steps:

(i) based on the application for which the panel is intended, the maximum acceptable cost and weight for producing said panel is determined, (ii) based on the application for which the panel is intended, the maximum mechanical stress likely to be exerted on said panel is determined, (iii) an elastic limit and a density are chosen for the sheets and the profiles, (iv) the optimal geometry is calculated, in particular, (a) the thickness of the sheets, (b) the geometry of the profiles, (c) the distance between the profiles, so as to obtain the panel having the lowest weight possible which withstands the stress determined in step (ii), and, if the weight obtained is greater than that determined in step (i), one returns back to step (iii), (v) the difference is calculated between, on the one hand, the cost of the solution obtained by making a suitable choice of metal materials for the optimized geometry in (iv), and, on the other hand, the cost determined in step (i) and, if it is positive, one returns back to step (iii), (vi) the sheets and the profiles chosen in step (v) are supplied, (vii) the sheets and the profiles are assembled by cold bonding or by friction stir welding.

Still other aspects of the invention are the use of a composite panel according to the invention as the floor of a rolling or flying vehicle or as the floor, deck or ramp of a floating vehicle.

BRIEF DESCRIPTION OF THE DRAWINGS

FIG. 2 shows an example of stress applied for calculating the geometry of the panel

DETAILED DESCRIPTION

The designation of alloys follows the rules of The Aluminum Association, known to those skilled in the art. Tempers and heat treatments are defined in the European Standard EN 515. The chemical composition of standardized aluminum alloys is defined, for example, in the Standard EN 573-3.

The term "sheet" is used here for rolled products of any thickness.

The term "profile" is used here to designate a wrought product having a uniform cross section over its entire length, other than a bar, wire, tube, sheet or strip.

According to the invention, a metal panel is referred to as composite in the sense that it consists of several metal elements assembled together. A metal composite panel according to an embodiment of the invention includes at least two sheets 21 and 22 substantially parallel and, arranged between them, profiles 3 substantially parallel to each other and fastened to said sheets. Profiles in a metal panel according to an embodiment of the invention number at least three and preferably at least ten, and serve as separators making it possible to separate said sheets. Profiles are arranged so that the average distance between two adjacent profiles is not necessarily uniform but suited to the local conditions of use of said panel.

In the case of a composite panel used as a truck floor, the profiles can thus be spaced farther apart in the portion of the panel close to the cab, over which no materials-handling machine can run, than in the portion close to the other end over which materials-handling machines travel. The precise adaptation of the panel to the local conditions of use makes it possible to significantly reduce the weight of the panel for a given application.

Figure 1:
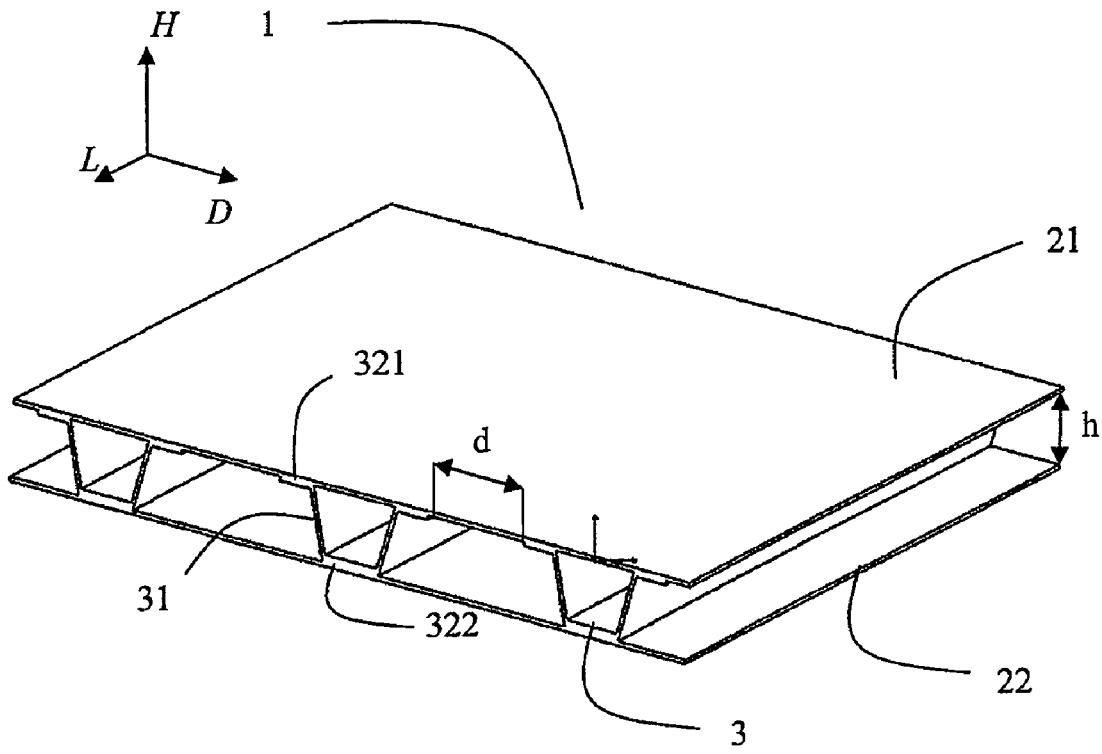
FIG. 1 shows an example of a composite panel in accordance with an aspect of the invention.

FIG. 1 shows a composite panel 1 according to an embodiment of the invention. Two sheets 21 and 22 are spaced apart and assembled via profiles 3. The sheets are spaced apart by a distance h which corresponds to the height of the profiles in the direction H perpendicular to the plane of the panel. Adjacent profiles are substantially parallel to each other in the direction L and spaced apart by an average distance d in the direction D. In the example of FIG. 1, the composite panel includes three profiles defining two distances d between identical profiles.

The ratio R=h/d between the distance between the sheets h and any of the distances d between adjacent profiles is carefully chosen. As a matter of fact, if this ratio R is too high, the panel does not locally have the desired mechanical strength and, if this ratio is too low, the weight of the panel per unit of area is locally too high. In one advantageous embodiment of the invention, the ratio R is between about 0.2 and about 1.5, and preferably between about 0.4 and about 1.0.

If the composite panel is used as flooring, it is advantageous to distinguish between the upper sheet 21, in contact with the transported load, and the lower sheet 22. It is advantageous for the upper sheet 21 to have mechanical properties ($R_{0.2}$, $R_m$) (Tension yield strength (TYS) and Ultimate tensile strength (UTS) respectively) and/or thickness superior to those of the lower sheet 22. The superior mechanical properties of this stronger sheet are obtained, in particular, by the choice of the alloy and/or the temper. Considering the stresses imposed, which are typically those of a floor capable of supporting motorized vehicles possibly transporting loads, the optimal thickness of the stronger, or upper, sheet is typically between about 2 and about 4 mm and that of the other, or lower, sheet is typically between about 1 and about 3 mm. The thickness of the upper sheet is advantageously at least about 30% and preferably at least about 50% thicker than the lower sheet, particularly when the lower sheet has mechanical properties at least equal to those of the upper sheet. For an engraved sheet, the thickness of the sheet is understood to mean the thickness without the thickness of the embossment. The upper sheet is directly in contact with the loads transported and must ensure mechanical functions as well as contact functions. The function of the lower sheet is to reinforce the panel assembly and, for certain applications, to protect the upper sheet and the profiles from exterior flying particles, in particular so as to prevent their corrosion. In one embodiment of the invention, however, an open-worked lower sheet is used in order to limit the weight of the panel.

Furthermore, in the case where the panel is used as flooring, it is advantageous for the upper face of the upper sheet to provide a non-skid function. An engraved sheet can advantageously be used, i.e., a sheet on which a pattern has been engraved or embossed, on one or both faces. The upper face of the upper sheet is advantageously engraved. It is also possible to use a sheet that has been rendered non-skid by any other method, for example, grooving or sanding. To illustrate, an embossment including a plurality of elongated lines, substantially linear or not, is well suited. Such patterns are known by the designations standardized in the Standard EN1386 "Damier (Checkered) 2," "Damier (Checkered) 5," "Losange (Lozenge)," "Grain d'orge (Barley corn)," "Amande (Almond)," as well as other designations such as "Grain de riz (grain of rice)," "Diamants (diamonds)," "Pomme de pin (pine cone)," "Damier (Checkered) 3" (derived from Damier (Checkered) 2 with three parallel lines instead of 2), "Damier (Checkered) 4" (derived from Damier (Checkered) 5 with 4 parallel lines instead of five). All of these designations succinctly and figurative describe the shape of the pattern. The "Damier (Checkered)" type of sheets are also called D2, D3, D4, D5, according to the number of parallel lines which make up the pattern. To illustrate, a pattern which is suitable for carrying out this invention is the one described in the French patent FR 2 747 948 (Pechiney Rhenalu), the entirety of which is hereby incorporated by reference.

When the panel is rectangular, the profiles can be oriented either in the direction parallel to the length of the panel or in the direction perpendicular to the length of the panel. When the panel is used as a floor for a rolling or flying vehicle, in particular such as a truck, a railway car, a cargo plane, or a material-handling means such as a container, the profiles are advantageously oriented in the direction perpendicular to the length of the panel, as in the example of FIG. 1, whereas, when the panel is used as a floor (in particular a stationary or temporary deck, a bridge) of a floating vehicle, the profiles are oriented in the direction parallel to the length of the panel.

The profiles used within the scope of the invention are preferably obtained by extrusion. The profiles 3 used in an embodiment of the invention include at least one transverse portion 31 intended to space apart the sheets and at least two lateral portions 321 and 322 intended to come into contact with the sheets 21 and 22, as shown in FIG. 3A.

At least one transverse portion 31 is advantageously inclined by 50 to 700, preferably by about 5° to about 60°, and more preferably between about 10° and about 45°, in relation to the direction perpendicular to the plane defined by the sheets. The end of the lateral portions in contact with the sheets is advantageously rounded, because an end with a sharp edge, typically a right angle, is disadvantageous to assemble by adhesive bonding. Typically, the thickness of the profile is not identical in the transverse portion and the lateral portions. In one embodiment of the invention, the thickness of the profile is greater in the transverse portion than in the lateral portions.

Figures 3A, 3B, 3C, 3D:
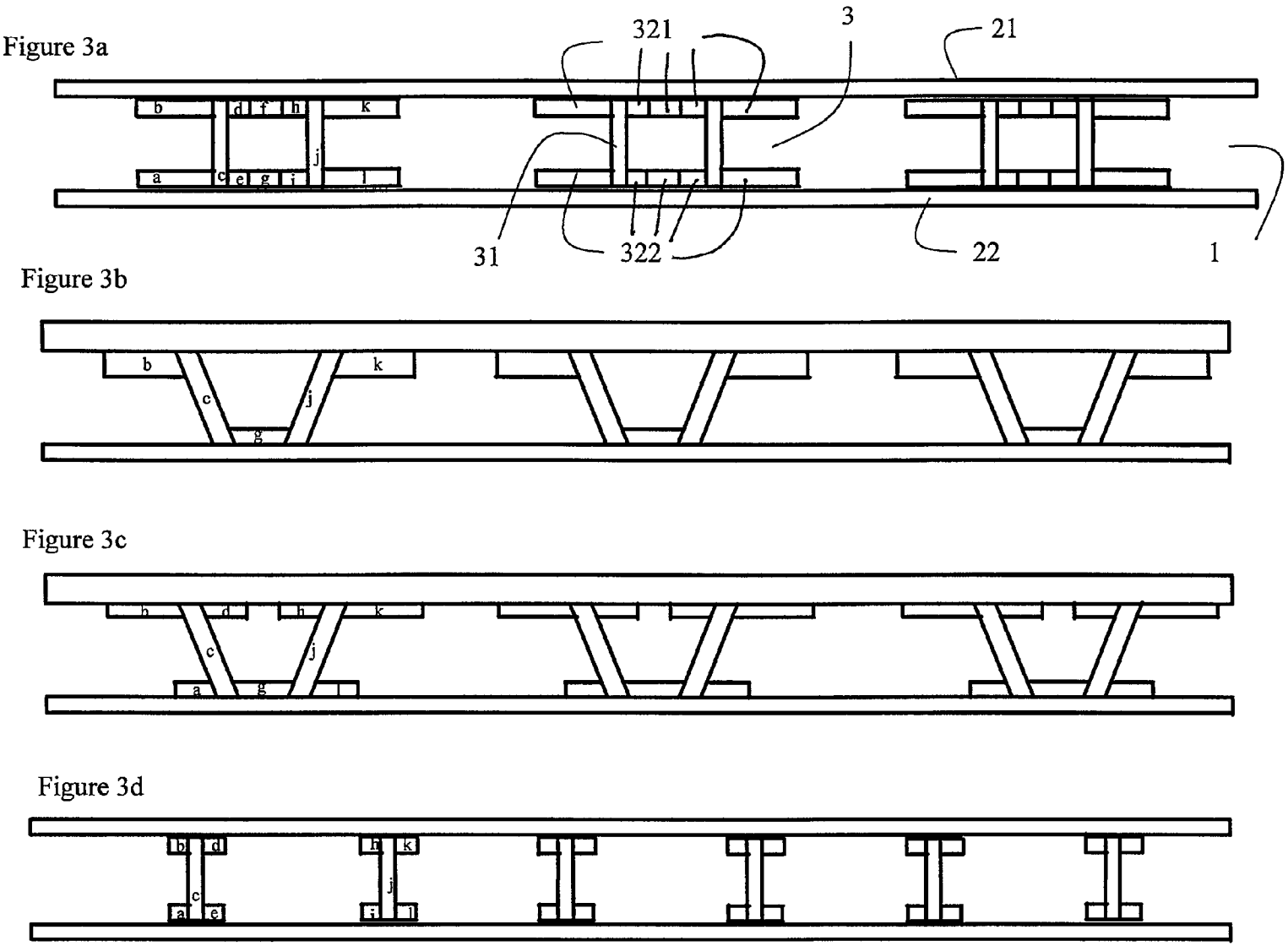
FIG. 3*a* shows an example of a starting geometry for calculating the parameters of the composite panel.
FIGS. 3*b* to 3*d* show three examples of geometries obtained.

In one embodiment of the invention shown in FIG. 3*b*, the profiles consist of at least five segments and preferably of five segments, referenced as b, c, g, j and k, the transverse portions 31 consisting of at least two segments and preferably of two segments c and j, the upper lateral portion 321 consisting of at least two segments and preferably of two segments b and k, and the lower lateral portion 322 consisting of at least one segment and preferably of one segment g, the segment g connecting the two transverse portions. A segment is a part of the profile section having two ends, either one unbound end and one end defined by a junction angle different from zero with another segment, or two ends defined by a junction angle different from zero with another segment.

In a preferred embodiment of the invention shown in FIG. 3*c*, the profiles consist of at least nine segments and preferably of 9 segments, referenced as a, b, c, d, g, h, j, k and l, the transverse portions 31 consisting of at least two segments and preferably of two segments referenced c and j, the upper lateral portion 321 consisting of at least four segments and preferably of four segments referenced b, d, h and k located on both sides of the transverse segments and the lower lateral portion 322 consisting of at least three segments and preferably of three segments a, g, l, the segment g connecting the two transverse portions.

The preferred embodiment shown in FIG. 3*c* is particularly advantageous when the composite panel is adhesively bonded. Hence, the segments added compared to a five segment geometry, that is segments d, h, and 1, enable to considerably reduce the stress within the adhesive. Thus, the maximum stress within the adhesive is at least 30% lower and sometimes at least 50% lower than for a configuration without the added segments. When the composite panel is adhesively bounded, preferred embodiments comprise profiles having at least two lateral segments, preferably horizontal, in contact with the upper sheet, located on both sides of at least one transversal segment and at least two lateral segments, preferably horizontal, in contact with the lower sheet, located on both sides of at least one transversal segment.

Additional profiles, having an identical or different geometry from the one used for the separator profiles 3, can be used along the periphery of the panel so as to partially or completely close the space between the sheets.

In order to obtain a panel having an optimal compromise between weight and performance, light alloys are favorable. In a preferred embodiment of the invention, the sheets and profiles are made of an aluminum alloy.

The sheets used within the scope of the invention are advantageously made of a 5XXX alloy, preferably a 5052, 5083, 5086 or 5383 alloy. For a panel used as flooring, a sheet made of a 5083, 5086 or 5383 alloy is advantageously used for the upper sheet while a sheet made of a 5052 or 5383 alloy is advantageously used for the lower sheet. The temper of the sheets used is typically an H temper.

The profiles used within the scope of the invention are advantageously made of a 5XXX alloy, typically in an H temper, or 6XXX, typically in the T5 or T6 temper.

Different alloy families are preferably used for the sheets, on the one hand, and for the profiles, on the other hand.

The corrosion resistance of the selected alloys is important, in particular for certain applications (in particular for panels intended for shipbuilding). In one embodiment of the invention, clad sheets are used. In the case where the panel is used as flooring, it is particularly advantageous for the lower face of the lower sheet to be clad.

The composite panels according to the invention are used as the floor of a rolling vehicle, as the floor, deck and/or ramp of a floating vehicle or as the floor of a flying vehicle.

The design and manufacture of the composite panel according to an aspect of the invention can be broken down into the following steps:

In a first step, based on the application for which said panel is intended, a determination is made of the maximum acceptable cost and weight for its construction. This technical-economic requirement is determined by various criteria possibly including, in particular, the cost of the existing solutions based on their weight.

In a second step, based on the application for which said panel is intended, a determination is made of the maximum mechanical stress likely to be exerted on the panel. This estimate can be made by a calculation required by a regulation or chosen on the basis of a particular use. In the case of shipbuilding, the level of stress and its method of evaluation is generally imposed by certification authorities members of IACS (International Association of Classification Societies) such as the DNV (Det Norske Veritas), Lloyd's Register, ABS (American Bureau of Shipping), and Veritas, in particular. For example, this type of specification is found in the DNV HSC Part 5, Chapter 2 "Car Ferry" rules.

In other specific cases, practical criteria are chosen which reflect the use that will be made of the panel. One example of applied stress is provided in FIG. 2. A mass 4 weighing two tons and having a surface area of 144 $cm^2$ (180 mm long by 80 mm wide) is applied to the composite panel 1 fastened onto two supports 5. The load simulates the wheel of a truck or a load-hauling vehicle. The load can be moved over the panel.

The target stress level can be defined in terms of deformation of the panel and/or in terms of the maximum level of acceptable local stress. The maximum level of acceptable local stress depends on the elastic limit of the materials used and the anticipated conditions of use. Thus, a safety factor is defined in relation to the elastic limit of the material, in order to take into account, among other things, the fatigue deformation conditions.

In a third step, an elastic limit and a density are chosen for the sheets and the profiles. These values are reasonably determined on the basis of materials utilized for constructing the panel.

In a fourth step, the optimal geometry for the composite panel is calculated. The objective of this step is to find the panel having the lowest possible weight which withstands the stresses determined in the second step. This geometry can be determined by numerical simulation or another calculation method.

In a first phase, a starting geometry is defined for calculating purposes. One advantageous example of a starting geometry is provided in FIG. 3*a*. The composite panel 1 consists of two sheets, an upper sheet 21 and a lower sheet 22, spaced apart and assembled via profiles 3 divided for calculating purposes into 12 sub-segments, each one referenced by one letter from "a" to "l". The transverse portions 31 consist of the sub-segments "c" and "j". The upper lateral portion 321, which is in contact with the upper sheet 21, consists of the sub-segments "b," "d," "f," "h" and "k". The lower lateral portion 322, which is in contact with the lower sheet 22, consists of the sub-segments "a, "e," "g," "i" and "l". A sub-segment is a calculation unit different from a segment which can, during numerical simulation, be suppressed and used alone or in a combination segment of the optimized solution. For example, several segments can be linked with a junction angle of zero (see FIG. 3*a*, sub-segments d, f h). In the case of a horizontal use of the panel, the upper sheet is preferably the sheet in contact with the load. The starting geometry used for the profile makes it possible to directly attain the majority of the final geometries of conceivable profiles.

The calculations, preferably carried out using finite elements, consist in varying the various parameters: thickness of the sheets, length and thickness of each sub-segment of the profiles, so as to obtain an optimized solution, i.e., a solution having the best compromise between the weight of the panel, the maximum level of the local stresses and/or of the deformation of the panel. Stress in the joints between components must be considered.

In calculating, the thickness of the sheets always remains greater than a minimum value of about 0.1 mm, and preferably about 0.5 mm. The thickness of the profile sub-segments is preferably either zero (in this case, the profile sub-segment is not used) or greater than a minimum value of about 0.5 mm, and preferably greater than about 1 mm. To generate two profiles, the length of the profile sub-segments having zero thickness may not be equal to zero (see FIG. 3*d*). The vertical sub-segments can advantageously be inclined, the angle between the direction perpendicular to the plane defined by the sheets H and the vertical segments, when they are inclined, being between about 5° and about 70° and advantageously between about 5° and about 60°, and preferably between about 10 and about 45°. Three examples of results obtained are provided in FIGS. 3*b* and 3*c* (case of a local applied load) and 3*d* (case of an applied load distributed over the entire surface).

In FIG. 3*b*, the geometry obtained for the profile is in the shape of an inverted "omega," the upper lateral portions "b" and "k" being thicker than the lower lateral portion "g". Moreover, the upper sheet 21 is thicker than the lower sheet 22. FIG. 3*c* shows an optimization in which the shearing of the adhesive at the end of the contact area has been taken into account.

In FIG. 3*d*, the geometry obtained for the profile is in the shape of an "I". FIG. 3*d* illustrates the concept that two profiles are generated when the profile sub-segments having zero thickness have non-zero lengths. The sub-segments "f" and "g" have a zero thickness but their length has increased in comparison with that of FIG. 3*a*.

For practical and economic reasons, it is possible to set certain parameters: it is possible, for example, to impose an identical thickness for the lower sheet and the upper sheet, or to impose an "omega" shape for the profile by limiting the number of sub-segments.

It is observed that, in many cases, optimization comes down to finding the best compromise between the height of the transverse portions (sub-segments "c" and "j" in FIG. 3) and the distance between the profiles.

Optimization can also take economic requirements into account, e.g., such as the cost of assembling the profiles with respect to the number of profiles used and the cost of manufacturing the optimized geometries.

The weight of the structure obtained by the first pass calculation is compared to the objective determined in the first step. If the weight obtained is greater than this objective, one goes back to the third step. Characteristics, such as length and thickness of the parts, of the proposed design are modified to obtain the pre-selected weight.

In a fifth step, the cost of the solution obtained can be calculated. Preferably, the metal alloys for reaching the elastic limit and density conditions are selected, and the cost is determined for obtaining the sheets and profile for these alloys in the optimized geometry. The difference between, on the one hand, the cost of the solution obtained by making an appropriate choice of the metal materials for the optimized geometry, and, on the other hand, the cost objective determined at the first step is calculated and, if it is positive, one goes back to the third step. Again, the characteristics, including for example the dimensions of the parts and the alloys from which they are made, are modified to obtain a suitable solution.

In a sixth step, the sheets and the profiles having the desired geometry are supplied in the selected alloy.

In a seventh step, the panel is preferably assembled. In order to prevent deformation during assembly, and to obtain a satisfactory flatness of the panel, the assembly is carried out using a method in which there is no melting of the metal. Methods requiring a heat treatment of the panel at a temperature greater than about 200° C. or even greater than about 150° C. (such as the treatment required for curing an adhesive) generate a loss of mechanical properties.

In a preferred embodiment of the invention, the sheets and profiles are assembled via adhesive bonding without curing, using a bicomponent epoxy type of adhesive, the elements being assembled via pressurization, typically between about 50 and about 100 kg/m$^2$, and the temperature of the panel not exceeding about 100° C., and preferably not exceeding ambient temperature, during the adhesive bonding step or later. So as to control the thickness of the adhesive, it is possible to introduce a metal wire of controlled thickness between the lateral portions of profiles 321 and 322 and the sheets 21 and 22. It is also possible to introduce balls of a calibrated diameter into the adhesive. In another embodiment of the invention, a protuberance of the surface of the profile is made in the direction H on the segments in contact with the sheets 321 and 322, so as to control the thickness of the adhesive.

A surface treatment is preferably carried out prior to assembly via adhesive bonding.

In yet another embodiment of the invention, the panels are assembled via friction stir welding.

EXAMPLES

Example 1

Figure 2A:
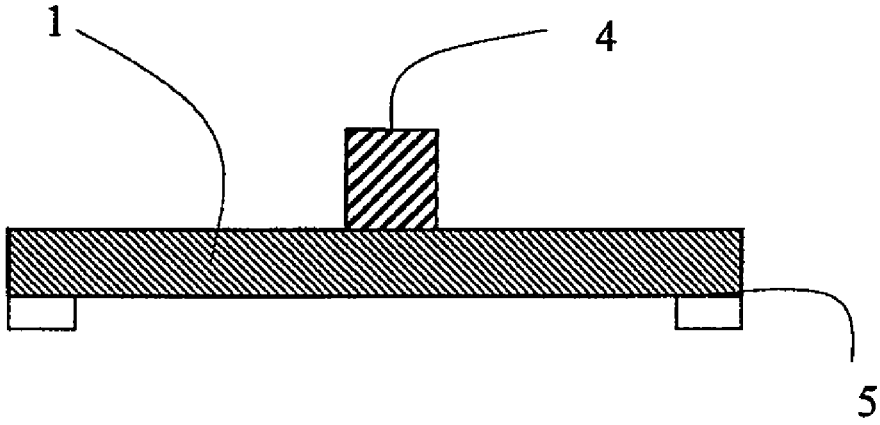
(FIG. 2*a*: sectional view.
Figure 2B:
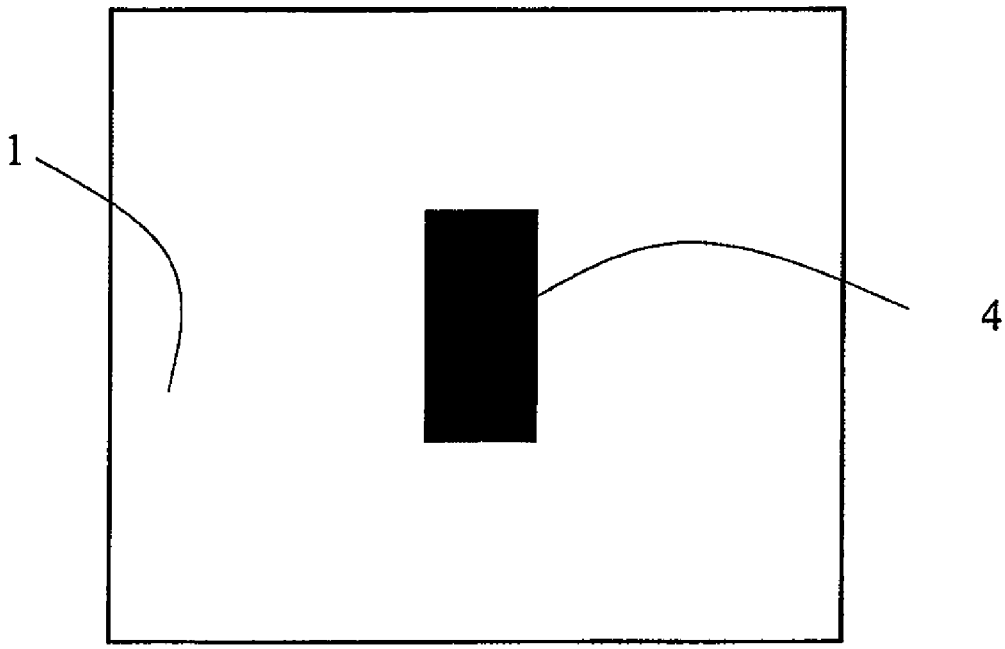
FIG. 2*b*: plan view).

In this example, the structure was calculated for a composite panel according to the invention, optimized for a stress as described in FIG. 2. A mass 4 of 2 metric tons with a surface area of 144 cm (length 180 mm, width 80 mm) was applied to the composite panel 1 fastened on two supports 5. The length of the panel was 13.8 m and its width was 2.3 m. The profiles were perpendicular to the lengthwise direction of the panel.

Among the optimization parameters, only the thickness of the sheets and the distance between profiles were optimized. The overall shape of the profile was not optimized; the "Omega" shape was used, as described in FIG. 4.

Figure 4:
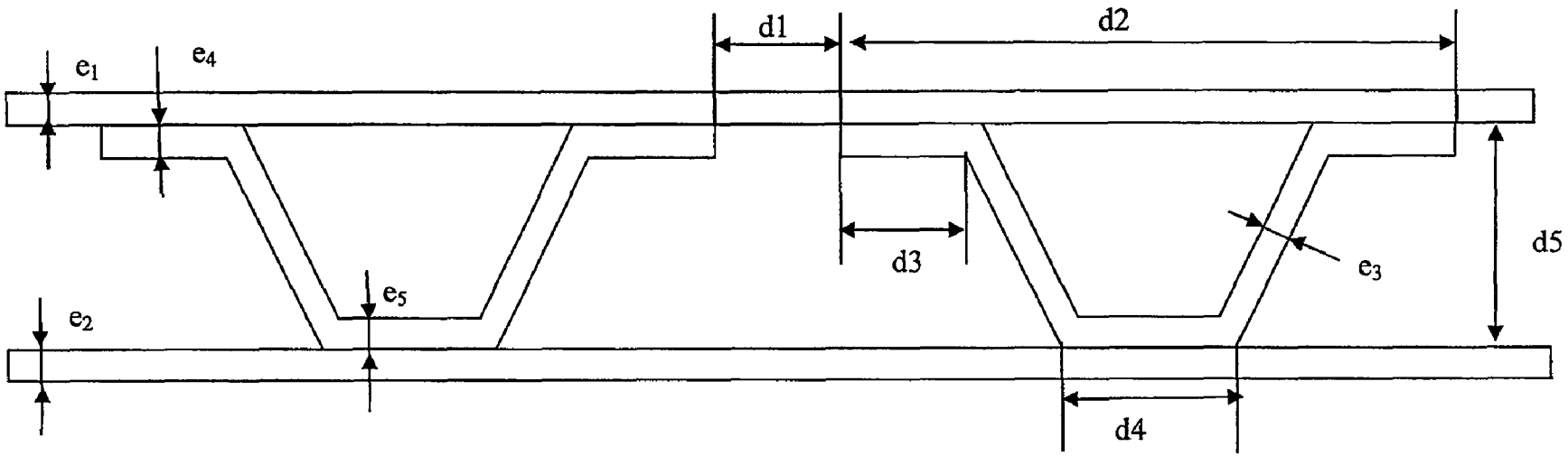
FIG. 4 shows the geometry used in connection with one embodiment.

FIG. 4 further summarises various parameters: thickness of the sheets ($e_1$: upper sheet and $e_2$: lower sheet), distance between the profiles d, thickness of the various portions of the profile ($e_3$: thickness of the transverse portion, $e_4$: thickness of the upper lateral portion in contact with the upper sheet and $e_5$: thickness of the lower lateral portion in contact with the lower sheet). The thicknesses of the various portions of the profile were fixed. A thickness of 2.8 mm was fixed for $e_3$ and $e_5$. A thickness of 5 mm was fixed for $e_4$. Values for $d_2$, $d_3$, $d_4$ and $d_5$ were set to 120 mm, 27 mm, 45 mm and 50 mm, respectively. The local stress was calculated for each unit cell of the calculation and the maximum local stress thus was obtained for each geometry involved. This maximum local stress can then be compared with a target value consistent with the strength of the materials and the required safety factors.

Figure 5:
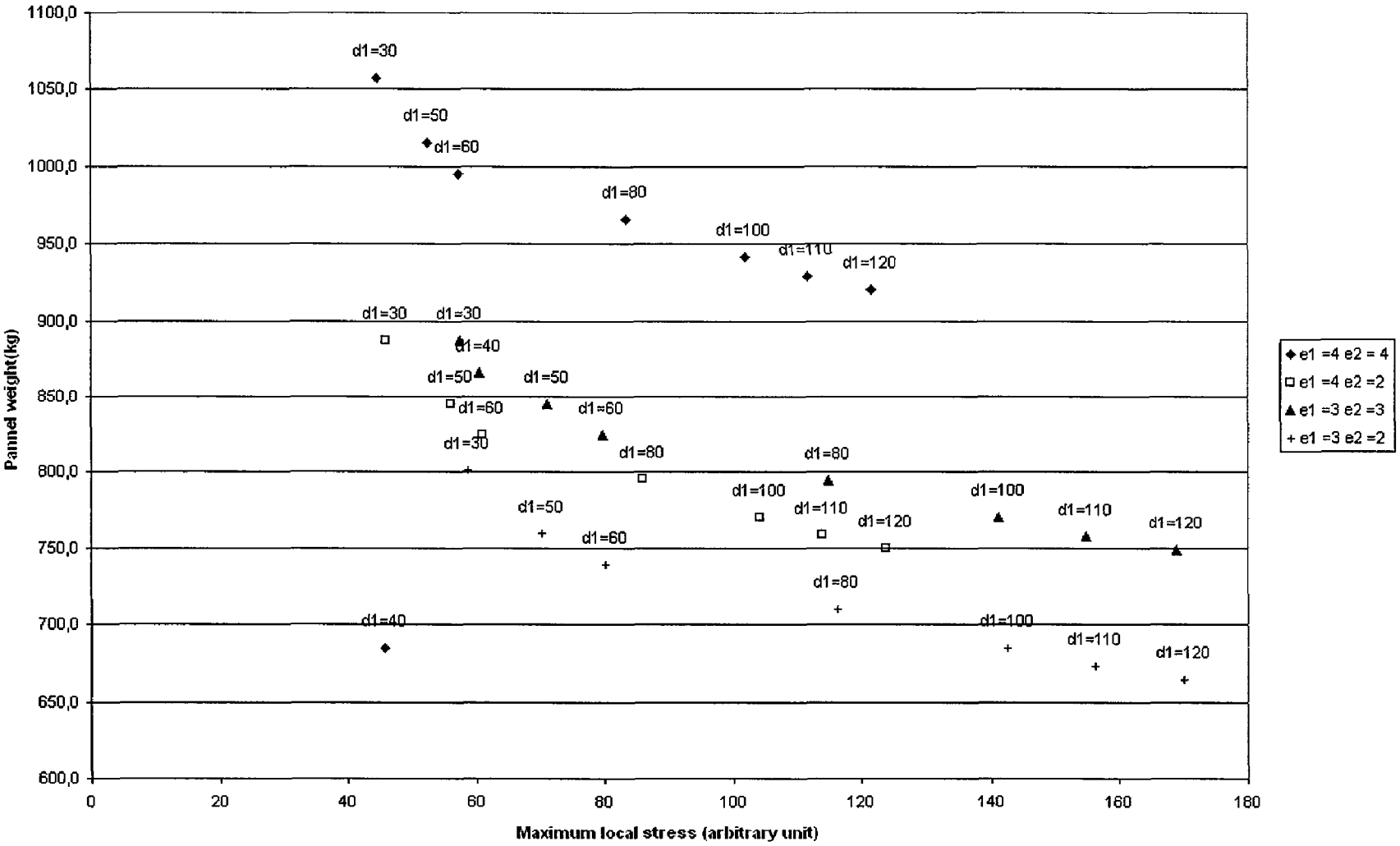
FIG. 5 shows the weight of the panel in relation to the maximum local stress, for various geometries used.

FIG. 5 shows the results obtained for various values of $d_1$, $e_1$ and $e_2$. In general, the heavier the panels, the lower the maximum local stresses, which results in the highest strength for the panels. The geometries in which the thickness of the upper sheet was greater than that of the lower sheet were preferred. The optimal distance between the profiles varies based on the thickness chosen for the upper sheet, thus, for a upper sheet thickness of 4 mm, the optimal distance for a maximum stress of approximately 115 (arbitrary unit) was d=110 mm, while for the same level of maximum stress, the optimal distance for an upper sheet thickness of 3 mm was d=80 mm.

In another embodiment, a panel was made in which the thickness of the upper sheet and that of the lower sheet were equal to 3 mm and the distance between the profiles was 80 mm. The upper sheet was made of 5086 alloy at H244 temper, while the lower sheet was made of 5383 alloy at H34 temper. The structural sheets were made of 6005 alloy at T6 temper. The sheets and the profiles were assembled via adhesive bonding using a bicomponent epoxy type adhesive. The thickness of the adhesive was controlled owing to a piano string positioned on the portions of the profiles in contact with the sheets, in the area of lowest stress. The adhesive was cross-linked under pressure without heating.

A sample of the panel obtained having a dimension of 500 mm by 1300 mm was tested under a force of 30,000 N applied at the center of the sample. No cracking was observed, whether on the adhesive, the profiles or the sheets. The maximum displacement observed was 6 mm.

Example 2

In this example, the structure was calculated for a composite panel according to the invention, optimized for a stress as described in FIG. 2. A load 4 of 0.4 MPa. with a surface area of 365 $cm^2$ (length 215 mm (parallel to the profiles), width 70 mm (perpendicular to the profiles)) is applied to the composite panel 1 fastened on two supports 5. The length of the panel was 2.4 m and its width was 0.6 m. The general shape of the profile was optimized. The "Omega" shape was used, as described in FIG. 4, as a starting point In a first calculation, the stress within the adhesive was not taken into account and the target was to obtain a maximum stress (von Mises) within aluminum lower than 200 MPa. The following parameters were optimized: thickness of the upper and lower sheet; distance between the profiles; profile shape (length and thickness of the various starting sub-segments). The local stress was calculated for each.

The local stress was calculated for each unit cell of the calculation and the maximum local stress thus was obtained for each geometry involved. The optimized geometry thus obtained was further optimized by taking into account the adhesive elasticity and the stress within the adhesive. For this second calculation, two starting points were compared: a first configuration (Geometry 1) which corresponds exactly to the optimized geometry obtained from the first calculation and a second configuration (Geometry 2) wherein 4 sub-segments were added to the shape described by FIG. 4, according to FIG. 6.

The optimized geometry obtained with Geometry 1 such as shown on FIG. 4 as a starting point had the following characteristics: $e_1$=2.5 mm, $e_2$=1.6 mm, $e_3$=3.5 mm, $e_4$=2 mm, $e_5$=1.9 mm, $d_1$=73 mm, $d_2$=104 mm, $d_3$=23 mm, $d_4$=49 mm, $d_5$=21 mm.

Figure 6:
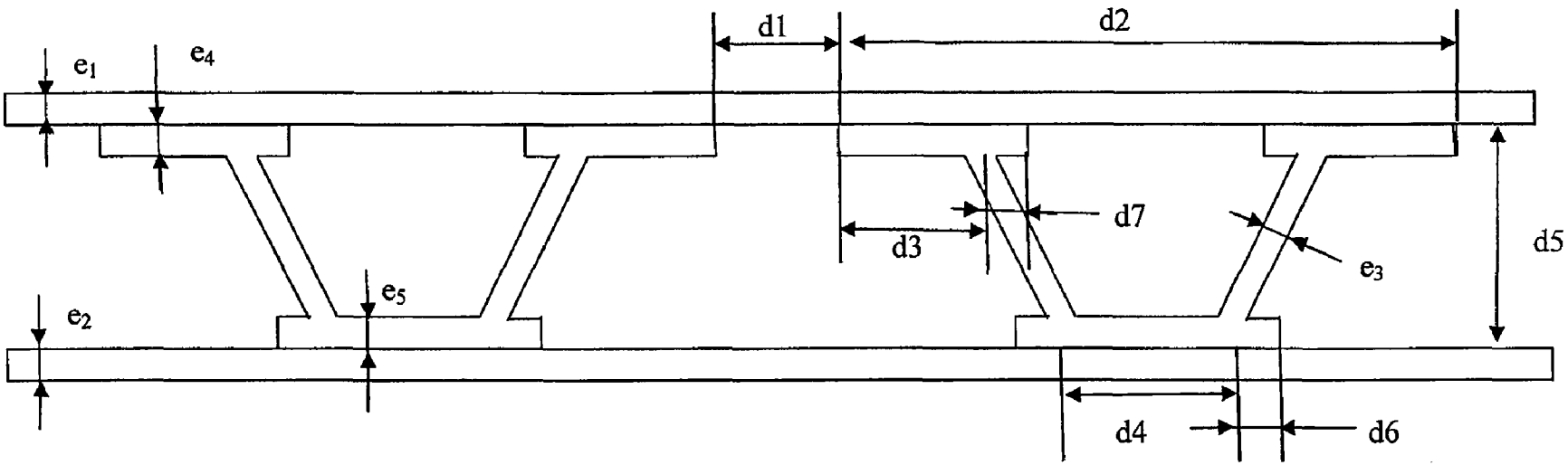
FIG. 6 shows Geometry 2 used in example 2.

The optimized geometry obtained with Geometry 2 such as shown on FIG. 6 as a starting point had the following characteristics: $e_1$=2.5 mm, $e_2$=1 mm, $e_3$=4 mm, $e_4$=1.85 mm, $e_5$=1.85 mm, $d_1$=73 mm, $d_2$=101 mm, $d_3$=25 mm, $d_4$=46 mm, $d_5$=36 mm $d_6$=2.3 mm and $d_7$=1.5 mm.

Calculated stresses are provided in Table 1.

TABLE 1

| | | | Geometry 1 | Geometry 2 |
|---|---|---|---|---|
| Stress in aluminum | Von Mises (MPa) | Maximum | 188 | |
| Stress in adhesive | Von Mises (MPa) | Maximum | 87 | 42 |
| | | Average value on the section | 16 | 18 |
| | | Average of the absolute value | 16 | 18 |
| | Stress in tension compression (direction of thickness) (MPa) | Maximum | 45 | 28 |
| | | Average value on the section | −1 | −1 |
| | | Average of the absolute value | 6 | 6 |
| | | Average fracture stress of the adhesive at 25° C. | 30 in tension | 30 in tension |
| | Shear Stress (MPa) | Maximum | 52 | 24 |
| | | Average value on the section | −1 | −1 |
| | | Average of the absolute value | 10 | 9 |
| | | Average fracture stress of the adhesive at 25° C. | 17 | 17 |

Geometry 2 is clearly advantageous, with a drop of about 50% of the various maximum stresses within the adhesive.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims. For example, different stress values, different alloys, and thickness can be adjusted to different values to obtain a different solution.

The invention claimed is:

1. A metal composite panel comprising at least two substantially parallel sheets and at least 3 separate profiles, having a length direction, fastened to said sheets, wherein said profiles are substantially parallel along said length direction, and wherein said profiles separate said sheets and are arranged so that the average distances between adjacent profiles are not necessarily equal but are suited to the local conditions of use of said panel, wherein said profiles have cross-sections perpendicular to said length direction, comprising transverse portions to space apart said sheets and at least two lateral portions to come into contact with said sheets, wherein the transverse portions comprise at least two transverse segments, and the lateral portions include an upper lateral portion comprising at least two lateral segments, and a lower lateral portion comprising at least one lateral segment connecting the at least two transverse segments, and wherein the lateral portions of each profile are spaced from the lateral portions of each of the other profiles.

2. The composite panel of claim 1 wherein the sheets are spaced apart by a distance h and the profiles are spaced apart by distances d, and the ratios between h and d are between about 0.2 and about 1.5.

3. The composite panel of claim 2 wherein the ratios between h and each d are between about 0.4 and about 1.0.

4. The composite panel of claim 1 wherein said panel has an upper sheet and a lower sheet, wherein said upper sheet is stronger because it has superior mechanical properties and/or a greater thickness than the lower sheet.

5. The composite panel of claim 4 wherein the sheets have an inner surface and an outer surface with the profiles fastened to the inner surfaces of the sheets, further comprising a non-skid treatment selected from the group consisting of sanding, engraving, embossing and blends thereof on the outer surface of the upper sheet.

6. The composite panel of claim 4 in which the lower sheet has a clad outer surface.

7. The composite panel of claim 4, wherein the thickness of the upper sheet is between about 2 and about 4 mm and the thickness of the lower sheet is between about 1 and about 3 mm.

8. The composite panel of claim 1 wherein said profiles are extruded.

9. The composite panel of claim 8 wherein the ends of the lateral portions of the profiles in contact with the sheets are rounded.

10. The composite panel of claim 9 wherein at least one transverse portion of a profile is inclined by 5° to 70° in relation to the direction perpendicular to the plane defined by the sheets.

11. The composite panel of claim 8 wherein the thickness of said profiles is greater in the transverse portion than in the lateral portions.

12. The composite panel of claim 1 comprising at least a first sheet and a second sheet wherein said lower lateral portion comprises at least two lateral segments, which are in contact with the first sheet, attached to at least one of the transverse segments and located on both sides of said at least one transverse segment, and said at least two lateral segments of said upper lateral portion are in contact with the second sheet, attached to said at least one transverse segment and located on both sides of said at least one transverse segment.

13. The composite panel of claim 12, wherein the sheets and the profiles are fastened by adhesive bonding under pressure without curing, the temperature of the panel not exceeding about 100° C. during or after the adhesive bonding step.

14. The composite panel of claim 13 in which the adhesive used is the bicomponent epoxy type.

15. The composite panel of claim 1 wherein said transverse portions comprise two transverse segments, and the upper lateral portion comprises two pairs of lateral segments, each of the transverse segments having one pair of lateral segments being attached thereto and located on both sides thereof, and the lower lateral portion comprises three lateral segments, one lateral segment of which connects the two transverse segments.

16. The composite panel of claim 1 wherein the sheets and profiles are made of an aluminum alloy.

17. The composite panel of claim 16 wherein the profiles are made of an aluminum alloy of the 5XXX series in an H temper or an aluminum alloy of the 6XXX series in the T6 temper.

18. The composite panel of claim 1 wherein the sheets are made of an aluminum alloy of the 5XXX series.

19. The composite panel of claim 18 wherein the sheets are made of a 5052, 5083, 5086 or 5383 aluminum alloy.

20. The composite panel of claim 1, wherein the sheets and the profiles are fastened by friction stir welding.

21. The composite panel of claim 1, wherein the profiles have identical structures and the average distances between adjacent profiles are not equal.

22. A metal composite panel comprising at least two substantially parallel sheets and at least 3 profiles, having a length direction, separate from one another and fastened to said sheets, wherein said profiles are substantially parallel along said length direction, and wherein said profiles separate said sheets and are arranged so that the average distances between adjacent profiles are not necessarily equal but are suited to the local conditions of use of said panel, wherein said profiles have cross-sections perpendicular to said length direction comprising transverse portions to space apart said sheets and at least two lateral portions to come into direct contact with said sheets, and wherein the transverse portions comprise at least two transverse segments, and the lateral portions include an upper lateral portion comprising at least two lateral segments, and a lower lateral portion comprising at least one lateral segment connecting the at least two transverse segments.

* * * * *